US005931056A

United States Patent [19]

Tsaur

[11] Patent Number: 5,931,056

[45] Date of Patent: Aug. 3, 1999

[54] FAN DEVICE WITH ADJUSTABLE ROTARY-ANGLE

[76] Inventor: Garry Tsaur, 19222 Tranbarger St., Rowland Heights, Calif. 91748

[21] Appl. No.: 08/953,684

[22] Filed: Oct. 17, 1997

[51] Int. Cl.[6] ..... F16H 35/08; F03D 5/06; B63H 3/00

[52] U.S. Cl. ..... 74/837; 416/79; 416/100

[58] Field of Search ..... 74/837, 600; 416/79, 416/100

[56] References Cited

U.S. PATENT DOCUMENTS 1,115,147 10/1914 Zabriskie et al. ..... 74/600 X 1,188,384 6/1916 Avery ..... 74/42

1,576,684 3/1926 Stuart ..... 74/600

*Primary Examiner*—Lenard A. Footland

*Assistant Examiner*—Brandon C. Stallman

*Attorney, Agent, or Firm*—Dougherty & Troxell

[57] ABSTRACT

A fan actuator device with an adjustable rotary angle having an upper connector rotated by a motor gear, a toggle mechanism formed by an upper connecting rod, a lower connecting rod and a coupling connector, a swinging arm connected to the coupling connector and a fan shelf and an adjusting handle. The upper and lower connecting rods are pivoted to an upper connector and the adjusting handle. Turning the adjusting handle changes the included angle between the upper and lower connecting rods, also changing the turning radius, to vary the swinging range of the fan.

1 Claim, 6 Drawing Sheets

FAN DEVICE WITH ADJUSTABLE ROTARY-ANGLE

BACKGROUND OF THE INVENTION

1. Field of the Invention

The present invention relates to an adjusting device, and more particularly, to a fan actuator device with an adjustable rotary angle which provides a virtual radius as a substitute for an original turning radius, allowing a user to increase or decrease this virtual radius. When increasing the virtual radius, the rotary angle of the fan will be larger, and when decreasing the virtual radius, the rotary angle of the fan will be smaller.

2. Description of the Prior Art

Most traditional rotary fans available in the market are controlled by the fan motor with a fixed turning radius that make the fan rotate at a fixed angle. Therefore, a user could only choose a fixed mode or a rotary mode with an unchangeable, predefined rotary angle. Such function is hard to suit the current environment and meet a user's requirements.

SUMMARY OF THE INVENTION

It is therefore a primary objective of the present invention to provide a fan actuator device, having an adjusting handle to lift or lower a lower connector that is connected to the adjusting handle. Adjusting the angle of a toggle mechanism formed by two connecting rods and one coupling connector, increases or decreases the virtual radius and makes the swinging arm change its rotary path and that of the fan actuator device to rotate at an angle range defined by a user.

BRIEF DESCRIPTION OF THE FIGURES

The drawings disclose an illustrative embodiment of the present invention which serves to exemplify the various advantages and objects hereof, and are as follows.

DETAILED DESCRIPTION OF THE PREFERRED EMBODIMENT

Figure 1:
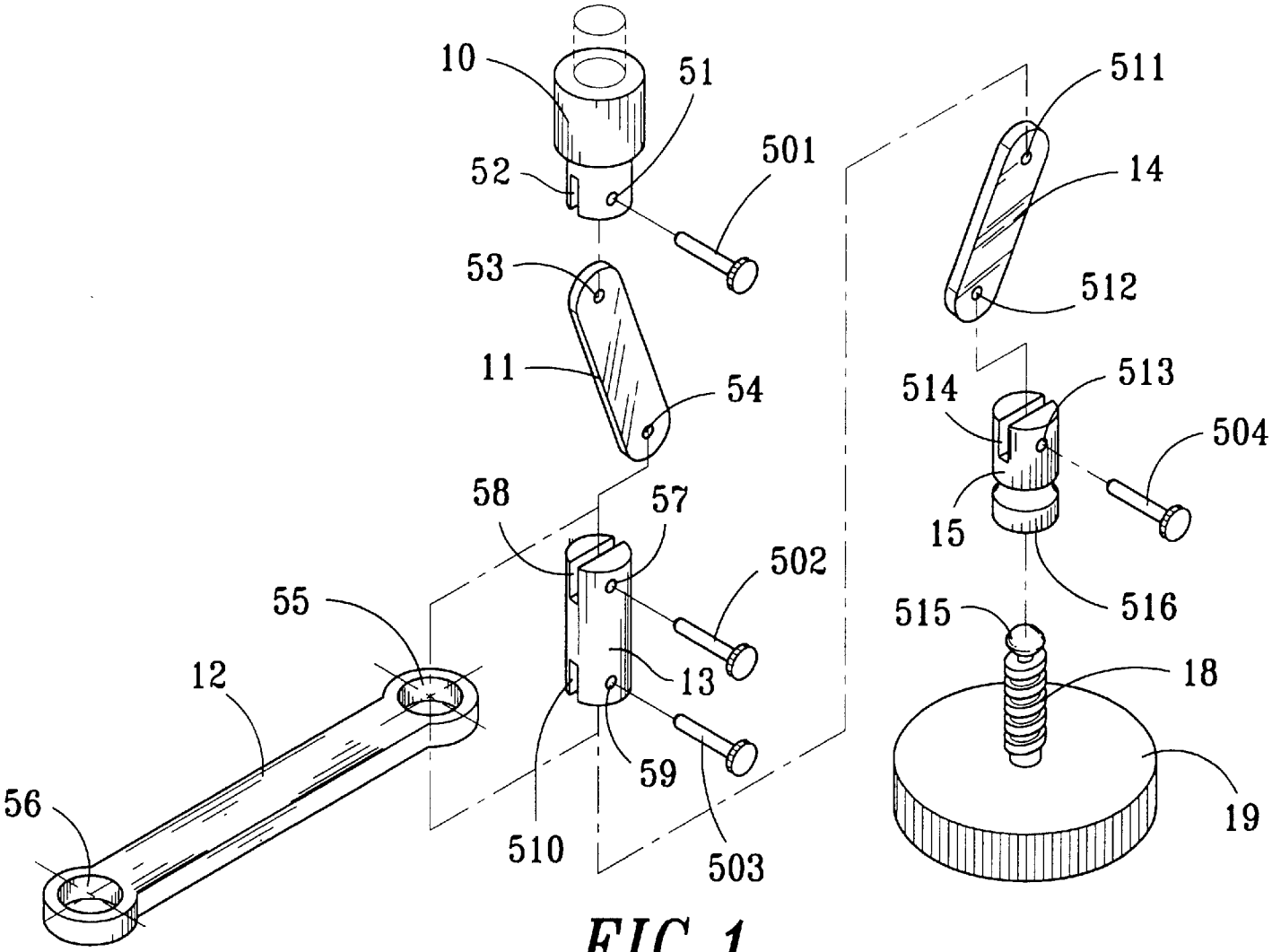
FIG. 1 is an exploded, perspective view of a fan actuator device with an adjustable rotary angle according to the present invention.

Please refer to FIG. 1. FIG. 1 is a diagrammatic view of a fan actuator device with an adjustable rotary angle according to the present invention. This actuator device has a rotatable adjusting handle 19 which lifts or lowers, to adjust the positions of the upper connecting rod 11 and lower connecting rod 14 which form a toggle mechanism. When changing the included angle and virtual radius of this toggle mechanism, it adjusts the rotary angle of fan actuator device. Motor 61 has driving motor axis 60, and drives fan blade 67 and motor gears 66. Motor gears 66 turn the upper connector 10 connected to motor gears 66, which then drives the upper connecting rod 11 connected to upper connector 10, rotating the upper connecting rod 11 and lower connecting rod 14 which form a toggle mechanism and driving the swinging arm 12 connected to this toggle mechanism. Motor pin 62 is inserted into hollow shaft 63 mounted on the fan shelf 65 and the swinging arm 12 fixes onto solid shaft 64 mounted on the fan shelf 65, producing a reaction force to rotate the fan.

Figure 2:
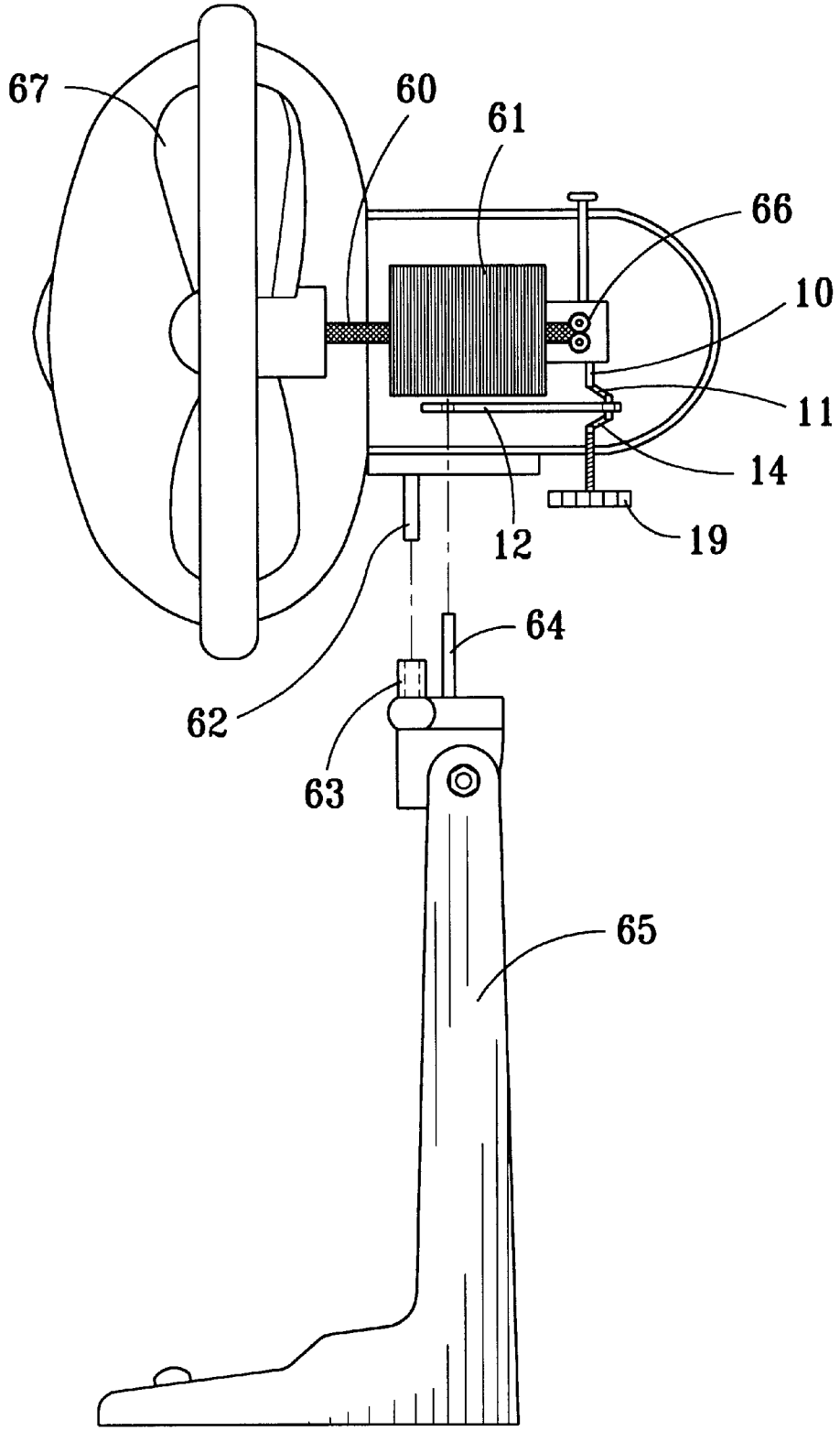
FIG. 2 is a side, exploded view of fan actuator device with an adjustable rotary angle according to the present invention.

Please refer to FIG. 2. FIG. 2 is an exploded view of the fan actuator device with an adjustable rotary angle according to the present invention. The upper connector 10 turns due to driving force from motor gears 66. The lower side of upper connector 10 with a hole 51 and slot 52, is connected to an upper connecting rod 11 with a hole 53 by pin 501. Connector 13 has holes 57,59 and slots 58,510. The upper connecting rod 11 is inserted into the slots 52,58 of upper connector 10 and coupling connector 13, and two pins 501,502 are inserted into holes 51,53 and holes 54,57. Such mutual connection between upper connector 10, upper connecting rod 11 and coupling connector 13 producing a relative pivot action. A swinging arm 12 with socket holes 55,56 at its ends, has socket hole 55 coupling with connector 13, and socket hole 56 coupling with solid shaft 64 which is mounted on the fan shelf 65. Ends of lower connecting rod 14 have holes 511,512 and lower connector 15 has hole 513 and a slot 514. Lower connector 15 also has a pivot suspension 516. Lower connecting rod 14 is inserted into slot 514 of lower connector 15 and slot 510 of connector 13, and is held in place by two pins 503,504 inserted into holes 59,511 and holes 512,513. Such mutual connection between coupling connector 13, lower connecting rod 14 and lower connector 10 also produces a relative pivot action. Adjusting handle 19 is formed with screw thread 18, and at an upper side has pivot bearing 515. Adjusting handle 19 threads into tapped hole 17 of motor outer bed piece 16, and pivot bearing 515 is inserted into pivot suspension 516 of lower connector 15.

Figure 3:
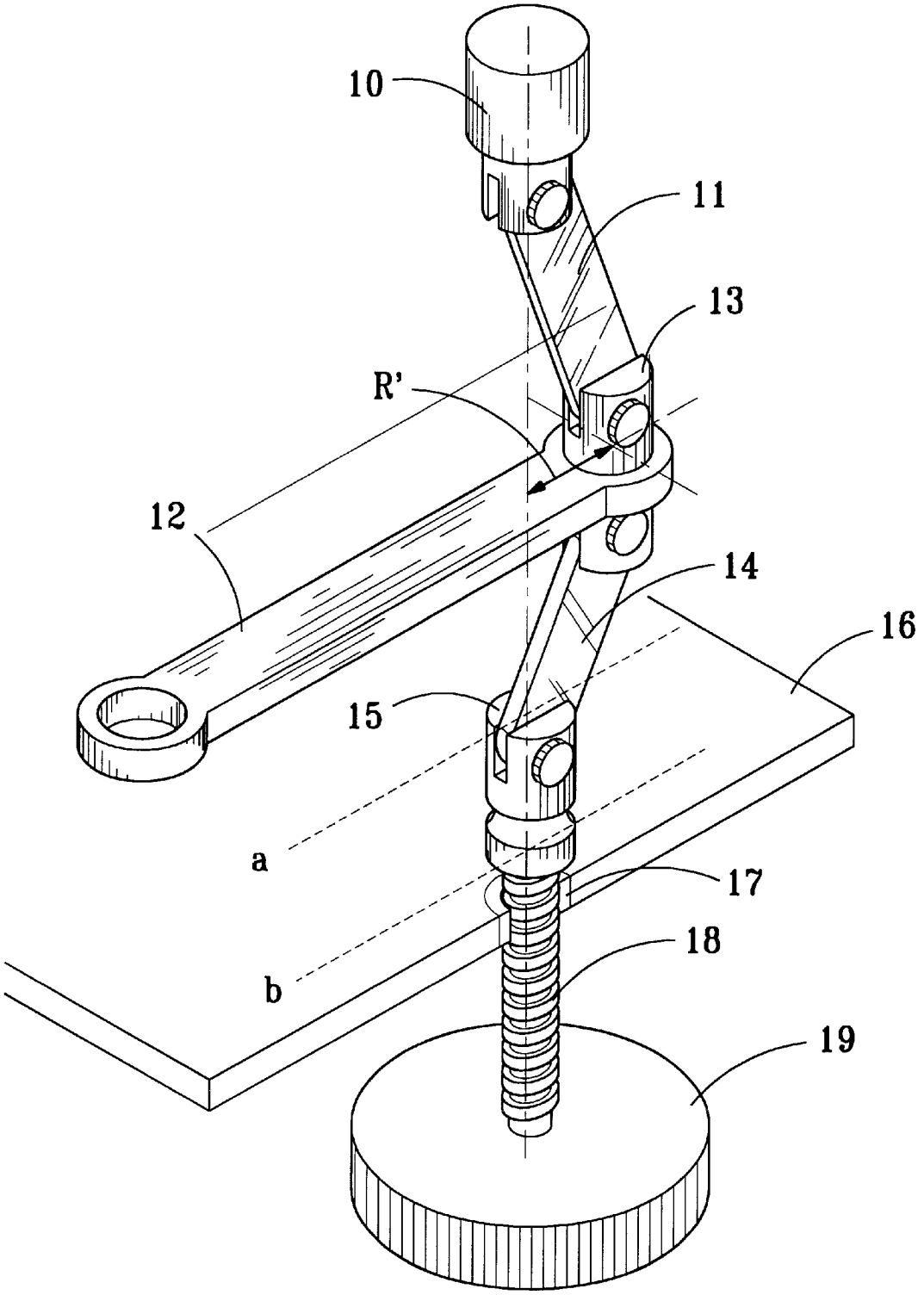
FIG. 3 is a perspective view of a first operational status according to the present invention.
Figure 5:
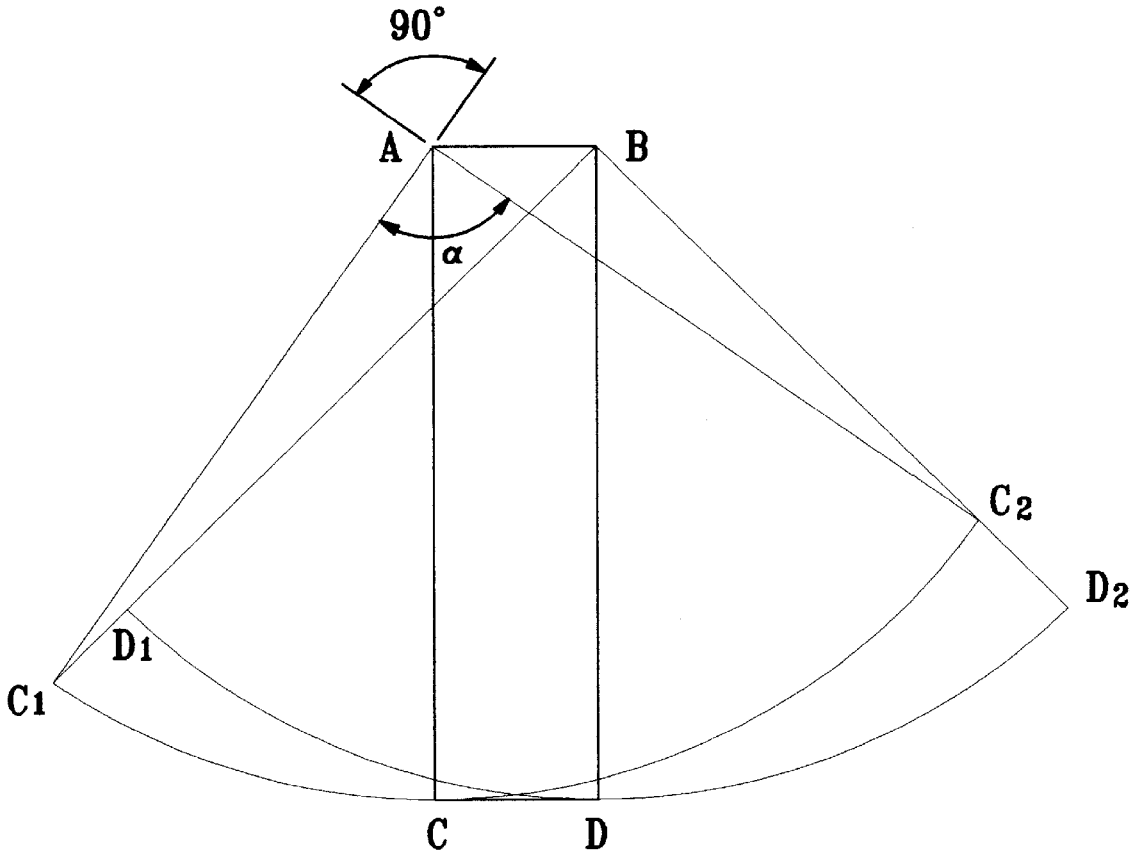
FIG. 5 is a schematic illustration of a rotary path with a fan actuator device under the first operational status according to the present invention.

Please refer to FIG. 3. FIG. 3 is a drawing of a first operational status according to the present invention. When a user turns the adjusting handle 19 clockwise, screw thread 18 of the adjusting handle 19 will follow the direction of tapped hole 17 of motor outer bed piece 16, and lift up the adjusting handle 19, driving lower connector 15 up to position-a. Due to the driving force from lower connector 15, the toggle mechanism formed by upper connecting rod 11, lower connecting rod 14 and coupling connector 13 will change its included angle. When the included angle decreases, the virtual radius R of this toggle mechanism will increase. The rotary angle of the fan also increases. As shown in FIG. 5, CD of square ABCD is the virtual radius, A and B are the fixed positions of hollow shaft 63 and solid shaft 64 on the fan shelf 65. If square ABCD rotates based on fixed point A, B, when points B, D1, C1 or B, C2, D2 are brought into line, the fan rotates, and contained angle $\alpha$ is just the same as rotary angle of the fan. As shown in the drawing, the length of CD has a close relation with included angle $\alpha$. When CD is longer, included angle $\alpha$ will be larger then the rotary angle of the fan will be larger. Conversely, when CD is shorter, included angle $\alpha$ will be smaller and the rotary angle of fan will be smaller.

Figure 4:
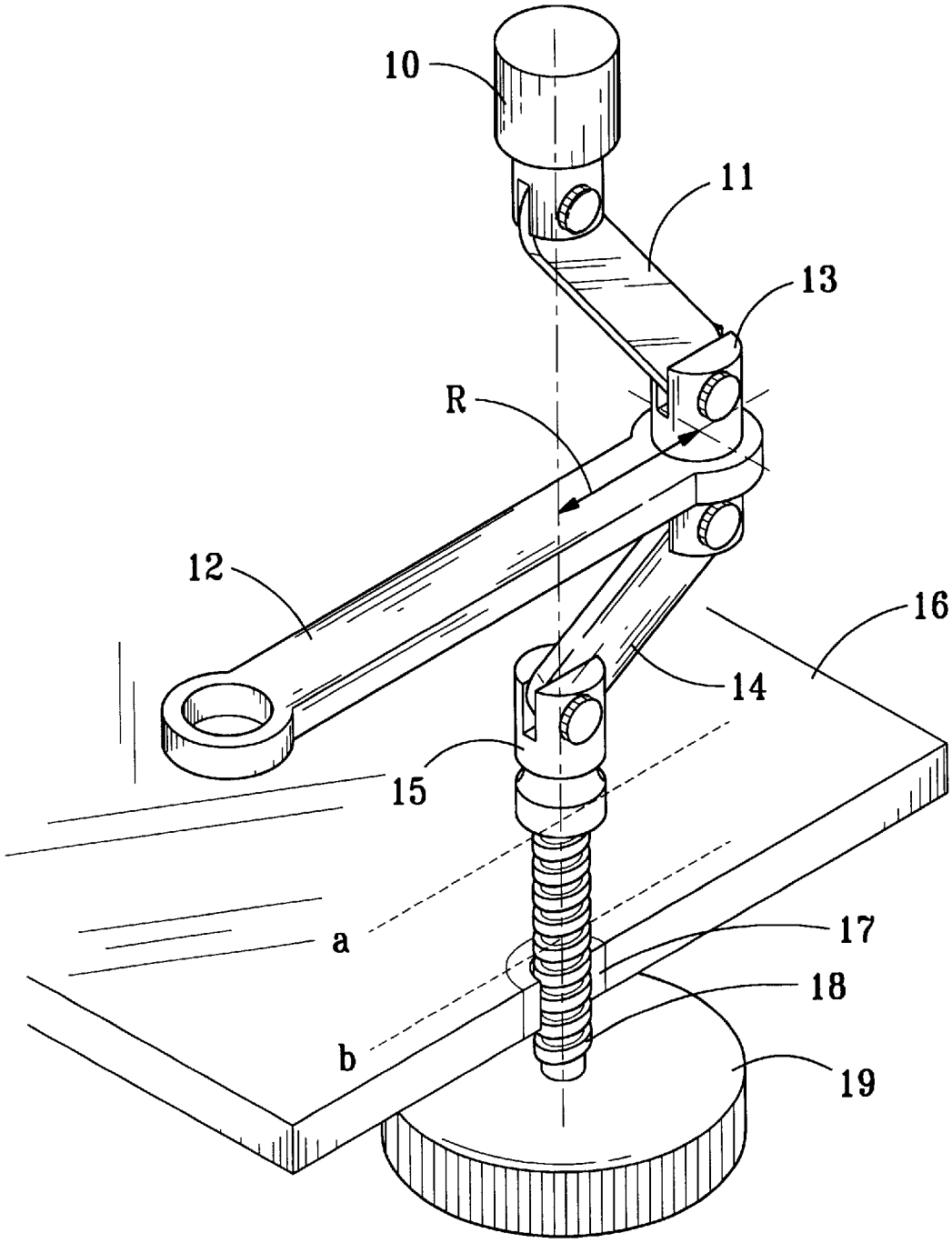
FIG. 4 is a perspective view of a second operational status according to the present invention.
Figure 6:
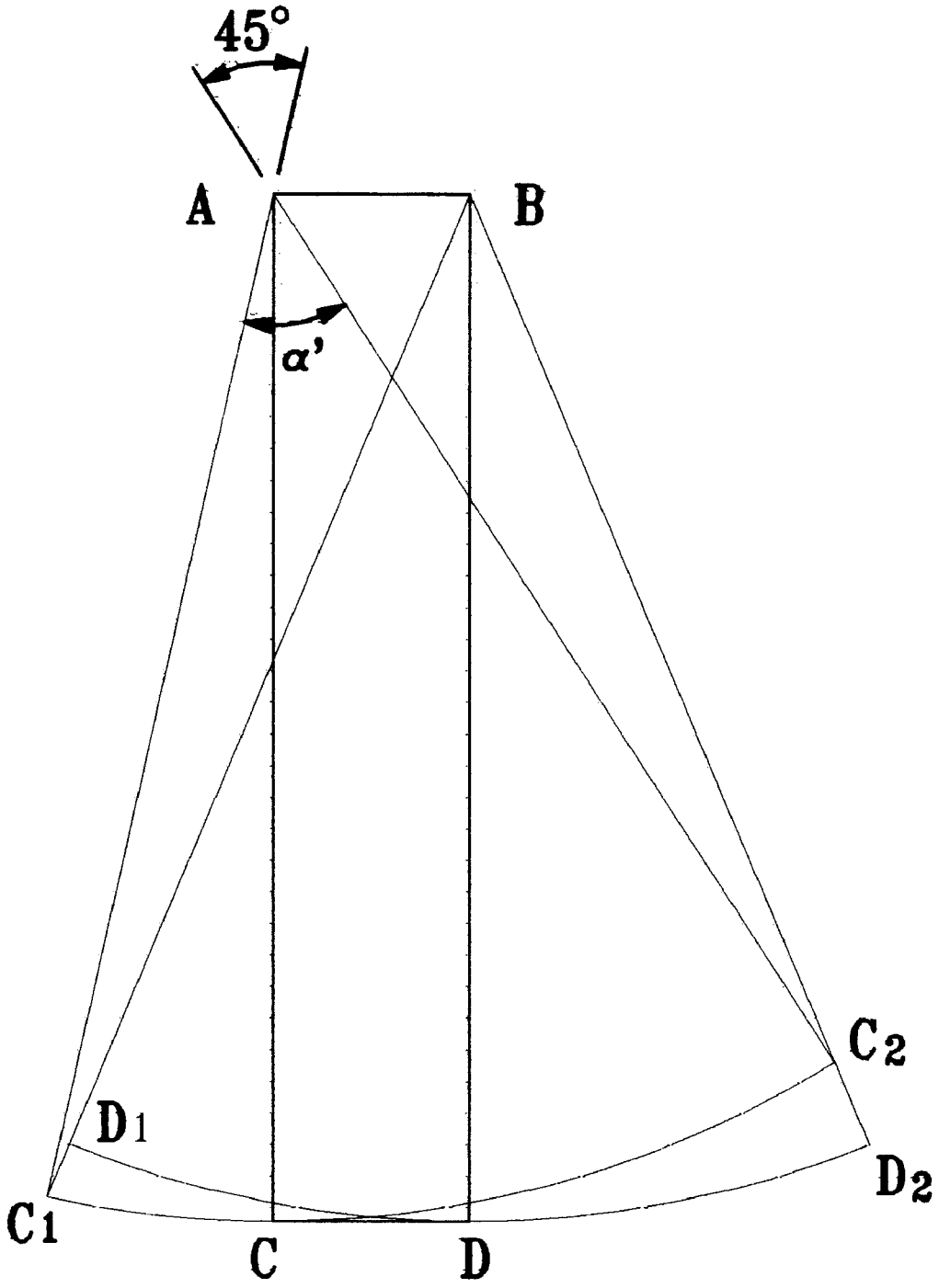
FIG. 6 is a schematic illustration of a rotary path with a fan actuator device under the second operational status according to the present invention.

Please refer to FIG. 4. FIG. 4 is a drawing of a second operational status according to the present invention. When the user turns the adjusting handle 19 counterclockwise to descend adjusting handle 19, the driving lower connector 15 is moved down to position-b. The included angle a becomes larger, virtual radius R' becomes smaller and the rotary angle of the fan also decreases. As shown in FIG. 6, the length of CD effects the included angle α'. Virtual radius R' is shorter than virtual radius R due to the lower connector 15 is pulled down to position-b. Therefore, the included angle α' is also smaller than included angle α and the rotary angle of the fan will be smaller.

The present invention improves the traditional fan which cannot adjust its rotary angle, utilizing a toggle mechanism to establish an adjustable virtual radius. Changing this virtual radius adjusts the rotary angle of the fan. Therefore, a user can adjust the rotary angle depending on his practical requirement and could further meet different needs from each user and each kind of environment.

Many changes and modifications in the described embodiment of the invention can, of course, be carried out without departing from the scope thereof. Accordingly, to promote the progress in science and the useful arts, the invention is disclosed and is intended to be limited only by the scope of the appended claims.

What is claimed is:

1. In combination with a fan, a rotary angle adjustment device comprising:

an upper connector rotatably connected and driven by a motor gear;

a motor outer bed piece having a threaded aperture;

an adjusting handle having a top portion, a bottom portion and a treaded shaft, said threaded shaft connected to aid motor outer bed piece through said threaded aperture, wherein said adjusting handle is adapted to be moved up or down, said top portion of said adjusting handle equipped with a lower connector;

a lower connecting rod and a upper connecting rod, both said connecting rods having a top portion and a bottom portion, wherein said top portion of said upper connecting rod is pivotably connected to said upper connector and said bottom portion of said lower connecting rod is pivotably connected to said lower connector;

a coupling connector having a first end and a second end, said first end pivotably connected to said bottom portion of said upper connecting rod, and said second end pivotably connected to said top portion of said lower connecting rod;

a fan shelf;

a swinging arm having a first end and a second end, said first end connected to said coupling connector and said second end connected to said fan shelf, wherein turning the adjusting handle to move up or down changes a contained angle between said upper connecting rod, said lower connecting rod and a swing range of said swinging arm, thereby adjusting the rotary angle of the fan device.

* * * * *